US007637502B2

(12) United States Patent
Ata et al.

(10) Patent No.: US 7,637,502 B2
(45) Date of Patent: Dec. 29, 2009

(54) SHEET PROCESSING APPARATUS WITH BRANCHING PATHS FOR POST-PROCESSING

(75) Inventors: Hironobu Ata, Susono (JP); Atsushi Ogata, Mishima (JP); Kenichiro Isobe, Shizuoka-ken (JP); Hiroharu Tsuji, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 532 days.

(21) Appl. No.: 11/212,650

(22) Filed: Aug. 29, 2005

(65) Prior Publication Data

US 2006/0071423 A1 Apr. 6, 2006

(30) Foreign Application Priority Data

Aug. 30, 2004 (JP) ..... 2004-249952
Aug. 15, 2005 (JP) ..... 2005-235114

(51) Int. Cl.
*B65H 39/10* (2006.01)

(52) U.S. Cl. ..... 271/303; 271/3.02; 271/3.03; 271/220; 270/58.11

(58) Field of Classification Search ..... 271/3.01, 271/3.02, 3.03, 220, 224, 303; 270/58.11, 270/58.12, 58.16
See application file for complete search history.

(56) References Cited

U.S. PATENT DOCUMENTS 5,112,034 A 5/1992 Uto et al. ..... 270/53
5,344,130 A * 9/1994 Suzuki et al. ..... 270/58.02
5,435,535 A 7/1995 Suzuki et al. ..... 270/53
5,480,130 A 1/1996 Suzuki et al. ..... 270/53
5,605,322 A 2/1997 Suzuki et al. ..... 270/58.13
5,639,079 A 6/1997 Suzuki et al. ..... 270/58.17
5,765,824 A 6/1998 Kawano et al. ..... 270/58.11
6,302,606 B1 10/2001 Hayakawa et al. ..... 400/625
6,318,718 B1 11/2001 Ogata et al. ..... 271/213
6,325,371 B1 12/2001 Araki et al. ..... 271/297
6,382,614 B1 5/2002 Fukatsu et al. ..... 270/58.11

(Continued)

FOREIGN PATENT DOCUMENTS

JP 1-127556 5/1989

(Continued)

*Primary Examiner*—Patrick H Mackey
*Assistant Examiner*—Gerald W McClain
(74) *Attorney, Agent, or Firm*—Fitzpatrick, Cella, Harper & Scinto

(57) ABSTRACT

A sheet processing apparatus which perform a process to sheets comprising a stacking tray on which stacks the sheets to be performed a process; a discharge roller pair; a first path in which conveys a sheet to the discharge roller pair, shorter than the length of the minimum sheet size being conveyed in the sheet conveying direction; a second path branched from the first path and meeting with the first path at the upstream side in the sheet conveying direction of the discharge roller pair; and a path switching member, wherein a first sheet conveyed while processing the sheets on the stacking tray is guided into the first path by the path switching member, and when the front end of the first sheet projects from the discharge roller pair, the discharge roller pair is apart from each other and the first sheet is held in the first path, and the path switching member is changed over, and a second conveyed sheet is guided into the second path, when the front end of the second sheet projects from the discharge roller pair by a prescribed length, the discharge roller pair is closed to each other, and the first and second sheets are discharged onto the stacking tray in superimposed state by the discharge roller pair.

16 Claims, 8 Drawing Sheets

U.S. PATENT DOCUMENTS

| | | | | |
|---|---|---|---|---|
| 6,382,616 | B1 | 5/2002 | Waragai et al. | 270/58.12 |
| 6,527,267 | B1 | 3/2003 | Kuwata et al. | 271/9.13 |
| 6,561,503 | B1 | 5/2003 | Ogata et al. | 270/58.12 |
| 6,637,996 | B1 | 10/2003 | Hayakawa et al. | 412/9 |
| 6,643,480 | B2 | 11/2003 | Kuwata et al. | 399/107 |
| 6,661,995 | B2 | 12/2003 | Isobe et al. | 399/410 |
| 6,912,044 | B2 | 6/2005 | Sekiyama et al. | 355/407 |
| 6,973,285 | B2 | 12/2005 | Sekiyama et al. | 399/367 |
| 2004/0217543 | A1 | 11/2004 | Fukatsu et al. | 271/207 |
| 2005/0035535 | A1 | 2/2005 | Ogata et al. | 271/220 |
| 2005/0133991 | A1 | 6/2005 | Ata et al. | 271/273 |
| 2005/0220521 | A1 | 10/2005 | Kuwata et al. | 399/407 |
| 2005/0248085 | A1 | 11/2005 | Sekiyama et al. | 271/293 |
| 2006/0071423 | A1 | 4/2006 | Ata et al. | 271/303 |

FOREIGN PATENT DOCUMENTS

| | | |
|---|---|---|
| JP | 5-254704 | 10/1993 |
| JP | 5-294543 | 11/1993 |
| JP | 9-202541 | 8/1997 |
| JP | 9-235069 | 9/1997 |
| JP | 11-171395 | 6/1999 |
| JP | 2001-233524 | 8/2001 |
| JP | 2002-226128 | 8/2002 |
| JP | 2003-81517 | 3/2003 |

* cited by examiner

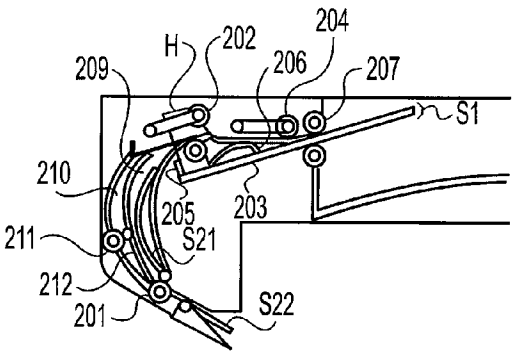
FIG. 2(e)
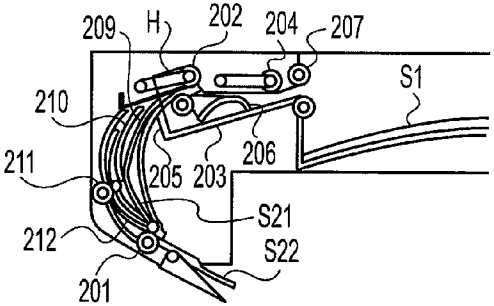
FIG. 2(f)
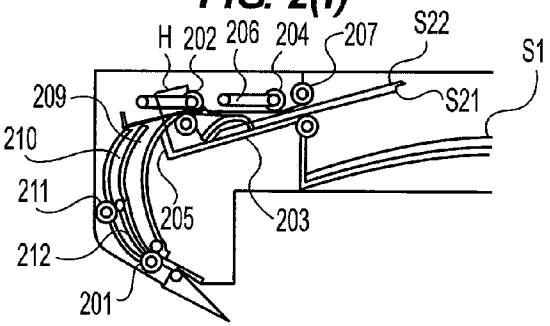
FIG. 2(g)
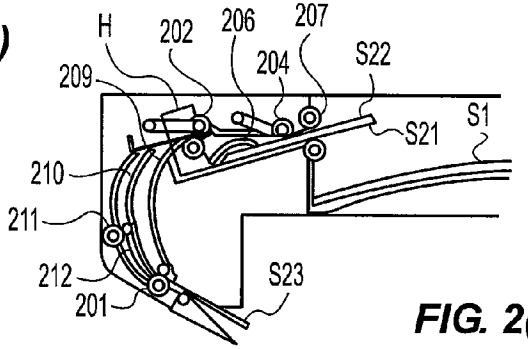
FIG. 2(h)
FIG. 2(i)

SHEET PROCESSING APPARATUS WITH BRANCHING PATHS FOR POST-PROCESSING

BACKGROUND OF THE INVENTION

1. Field of the Invention

The present invention relates to a sheet processing apparatus connected to an image forming apparatus for collecting, aligning and post-processing the sheets discharged from the image forming apparatus, and more particularly to an apparatus having a stacking tray for stacking and aligning a plurality of sheets temporarily.

2. Description of the Related Art

Hitherto, the sheet processing apparatus is connected to an image forming apparatus, for conveying the sheets discharged from the image forming apparatus, aligning and sewing, and moving the sewn sheet bundle to a stacking tray. At this time, while processing the sheet bundle, next sheet bundle cannot be sent into the stacking tray, and the throughput is lowered. To solve the problem of throughput decline, it has been attempted to produce a post-processing time by temporarily superimposing and stacking two sheets before the nip section of the roller for discharging the sheets to the sheet stacking tray, before discharging sheets to the sheet stacking tray, and discharging two sheets in superimposed state onto the stacking tray, thereby preventing decline of throughput.

However, as shown in Japanese Patent Application Laid-Open (JP-A) No. 9-235069, in the configuration designed to discharge sheets to a stacking tray, after superimposing while aligning the ends of two sheets by hitting the sheets conveyed from above to below against the roller for discharging sheets to the stacking tray, since the end of sheet abuts against the discharge roller as sheet end stopper by the own weight, a wide space is needed for temporarily stacking the sheet in the conveyance path up to the discharge roller (a longer conveyance path than the maximum sheet size for post-processing is needed), and the apparatus is larger in size, and is higher in cost.

Or as disclosed in JP-A No. 1-127556, by stopping a first sheet conveyance roller, a first sheet is stopped before stacking tray discharge roller, and when the end of second sheet reaches before discharge roller pair by second sheet conveyance roller, by driving the first sheet conveyance roller, two sheets are conveyed simultaneously, and two sheets in superimposed state are discharged onto stacking tray, and even in such configuration, enough space for completely holding the first sheet within the conveyance path is required, and the apparatus is larger in size and higher in cost.

In the configurations disclosed in JP-A No. 9-235069 and in JP-A No. 1-127556, by stopping second sheet once when superimposing two sheets, the paper space to third sheet (the time until third sheet is stacked on stacking tray) is shortened, and enough aligning process time may not be produced.

SUMMARY OF THE INVENTION

It is hence an object of the invention to provide an inexpensive sheet processing apparatus of small size, not lowered in throughput of the connected image processing apparatus.

To solve the problems, a representative configuration of sheet processing apparatus of the invention is a sheet processing apparatus for processing sheets including a stacking tray for stacking sheets for post-processing, a discharge roller pair aparting from each other for discharging sheets on the stacking tray, a first path for conveying sheets to the discharge roller pair, shorter than the length of the minimum sheet size being conveyed in the sheet conveying direction, a second path branched from the first path and meeting with the first path at the upstream side of the discharge roller pair in the sheet conveying direction, a path switching member disposed at the branching point for guiding the sheets selectively to the first path or second path, a first conveyance roller disposed at the upstream side in the sheet conveying direction from the branching point, and a controlling device for controlling sheet conveyance, in which the controlling device controls to change over the path switching member, guide the conveyed first sheet into the first path, apart the discharge roller pair from each other after the front end of the first sheet has passed the discharge roller pair, change over the path switching member after the rear end of the first sheet has passed the discharge roller pair, guide the conveyed second sheet into the second path, hold the first sheet in the first path, convey the second sheet by a specified extent and then hit against the discharge roller pair, and discharge the first sheet and second sheet in superimposed state on the stacking tray by the discharge roller pair.

According to the invention, by aparting the discharge roller pair from each other, the sheet can be stacked in a state of sheet front end projecting from the discharge roller pair, and therefore not only the space for temporarily placing the sheet can be used as the conveyance path before discharge roller pair, but also the space above the stacking tray can be used as temporary stacking space. As a result, unlike the prior art, it is not required to have a wide space for placing the sheets temporarily in the conveyance path before the discharge roller pair, and therefore decline of throughput can be prevented without increasing the size of the apparatus. Besides, abutting of front end is not required at the time of temporary placing, sheet damage by abutting of front end can be prevented. Besides, jamming by sheet buckling due to abutting of front end is avoided, and a product of high reliability can be provided. When superimposing the second sheet, the second sheet is not stopped temporarily, and jamming of paper space between the second sheet and a third sheet is avoided, so that a sufficient aligning process time can be reserved.

BRIEF DESCRIPTION OF THE DRAWINGS

FIG. 2(*b*) is a diagram explaining the operation of sheet processing apparatus.

FIG. 2(*c*) is a diagram explaining the operation of sheet processing apparatus.

FIG. 2(*d*) is a diagram explaining the operation of sheet processing apparatus.

FIG. 2(*e*) is a diagram explaining the operation of sheet processing apparatus.

FIG. 2(*f*) is a diagram explaining the operation of sheet processing apparatus.

FIG. 2(*g*) is a diagram explaining the operation of sheet processing apparatus.

FIG. 2(*h*) is a diagram explaining the operation of sheet processing apparatus.

FIG. 2(*i*) is a diagram explaining the operation of sheet processing apparatus.

FIG. 3(*b*) is a top view of sheet processing apparatus.

FIG. 5(*b*) is a diagram explaining the operation of sheet processing apparatus.

FIG. 7(*b*) is a diagram explaining the operation of sheet processing apparatus.

FIG. 7(*c*) is a diagram explaining the operation of sheet processing apparatus.

FIG. 7(*d*) is a diagram explaining the operation of sheet processing apparatus.

FIG. 7(*e*) is a diagram explaining the operation of sheet processing apparatus.

DESCRIPTION OF THE PREFERRED EMBODIMENT

First Embodiment

Figure 1:
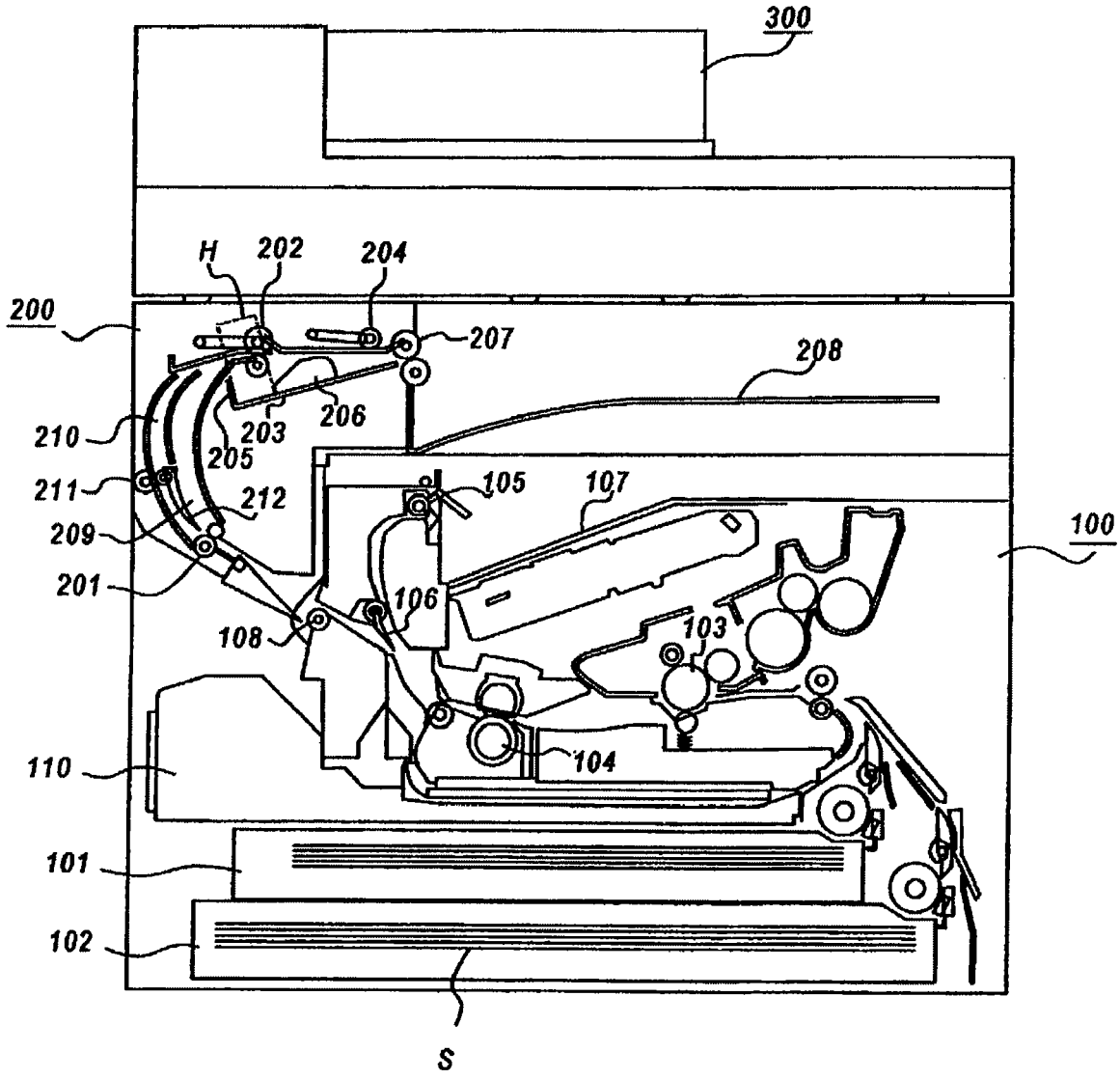
FIG. 1 is a schematic sectional view of image processing apparatus having a sheet processing apparatus according to a first embodiment.
Figure 2A:
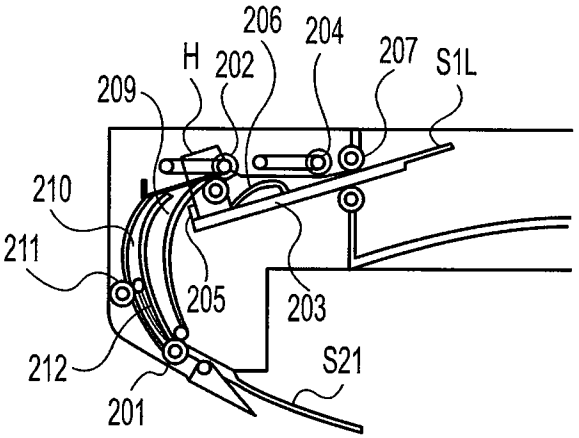
FIG. 2(*a*) is a diagram explaining the operation of sheet processing apparatus.
Figure 2B:
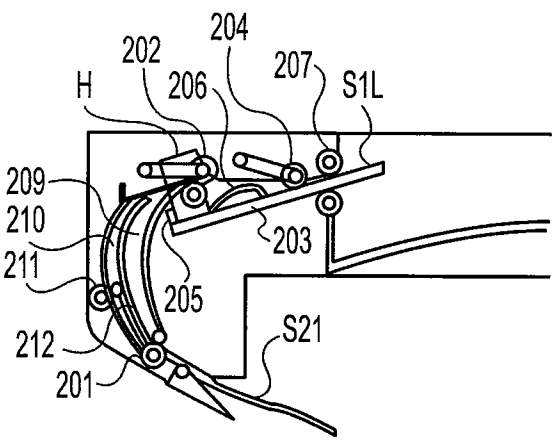
Figure 2C:
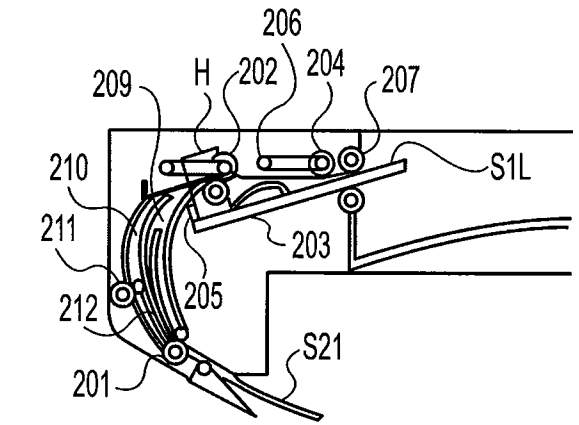
Figure 2D:
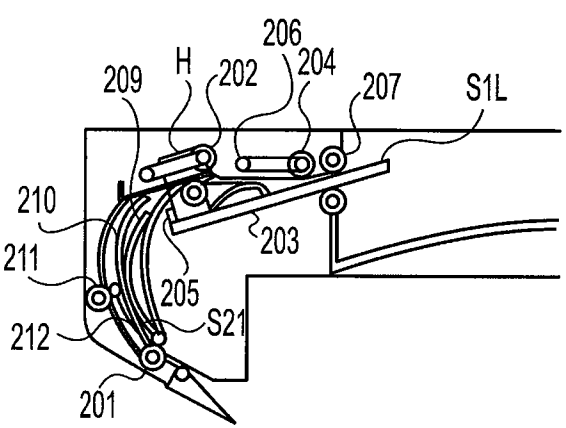

FIG. 1 is a schematic sectional view of image processing apparatus having a sheet processing apparatus according to a first embodiment. The image processing apparatus on the whole shown in the drawing is an internal discharge type configuration in which an image reading apparatus 300 is disposed above an image forming apparatus 100, and sheets on which images are formed are discharged into a space formed between the image forming apparatus 100 and image reading apparatus 300, and a sheet processing apparatus 200 can be installed in this space. The image forming apparatus 100 receives image information or print signal and the like sent directly from a computer connected thereto or via network of LAN or facsimile, or image information read by the image reading apparatus 300, and forms images on sheets by specified image process based on such information, and discharges sheets.

First, referring to FIG. 1, the configuration of the image forming apparatus 100 is explained along the route of conveyed sheet S. In the image forming apparatus 100, a plurality of sheets S are stacked in an upper feed cassette 101 and a lower feed cassette 102, and the top sheet is separated and supplied each from either cassette by various rollers. By a specified print signal supplied from the computer, network or image reading apparatus 300, the sheet S supplied from the upper feed cassette 101 or lower feed cassette 102 is processed in the image forming apparatus 100, and a toner image is transferred on the top of the sheet S in the image forming unit 103 for forming a toner image by image forming process of laser beam system. In succession, in the sheet S, heat and pressure are applied from a fixing device 104 at downstream side, and the toner image is permanently fixed.

The image forming apparatus 100 includes a controlling device 110 for controlling various operations, and the operation of sheet processing apparatus 200 described below is also controlled by the controlling device 110. A control unit may be provided at the sheet processing apparatus 200 side, and the operation of the sheet processing apparatus 200 may be controlled through this control unit.

The sheet S of which image side is fixed in the upper side state is conveyed in a U-shaped sheet conveyance route up to discharge roller 105 as shown in FIG. 1, and the image side is inverted, and with the image side at the lower side, it is discharged face-down to outside from the image forming apparatus 100 by the discharge roller 105. Based on control signal from the controlling device 110, the position of discharge port switching flapper 106 is changed over, and it is selected whether the sheet S is discharged directly into a face-down discharge unit 107 provided in the upper part of the image forming apparatus 100, or discharged by way of the sheet processing apparatus 200.

Referring to FIG. 1, the configuration of the sheet processing apparatus 200 is explained together with conveying operation of sheet S by switching of the conveyance route by the discharge port switching flapper 106. The sheet S is conveyed by a transfer roller 108, and conveyed into the sheet processing apparatus 200.

As shown in FIG. 1, the sheet processing apparatus 200 includes a stacking tray 203 for stacking sheets for post-processing, a discharge roller pair 202 for discharging sheets onto the stacking tray and contacting with or aparting from a nip, a first path 209 shorter than minimum sheet size for post-processing for conveying sheets onto the stacking tray 203, and a second path 210 branched from the first path 209 and meeting with the first path 209 at the upstream side of the discharge roller pair 202. The sheet processing apparatus 200 further comprises a switching flapper 212 as an example of path switching member for selectively guiding the sheet into the first path 209 or second path 210, a first path roller 201 as an example of first conveyance roller disposed at the upstream side from the branching point, and a second path roller 211 as an example of second conveyance roller disposed in the second path 210 working with the first path roller 201. The second path 210 is the outer side of the first path 209, that is, the conveying side of the first path 209, and is disposed at the opposite side of the mounting side to the stacked tray 203.

The stacking tray 203 includes a return roller 204 for aligning the stacked sheets in the sheet conveying direction, a reference wall 205 against which rear ends of sheets returned by the return roller 204 abut, a lateral aligning plate 206 for aligning the sheets in a direction orthogonal to the sheet conveying direction, a stapler H for sewing the matched sheet bundle, and a discharge roller 207 for discharging the post-processed sheet bundle to the discharge tray 208 outside of the machine.

In this constitution, the conveyance route is changed over to the sheet processing apparatus 200 side by the discharge port switching flapper 106, and the sheet S is introduced into the sheet processing apparatus 200 by the transfer roller 108. The sheet S is discharged onto the stacking tray 203 by the discharge roller pair 202, and matched and processed by the return roller 204 and lateral aligning plate 206, and sewn and processed by the stapler H, and discharged outside of the machine as sheet bundle by the discharge roller 207.

Figure 3A:
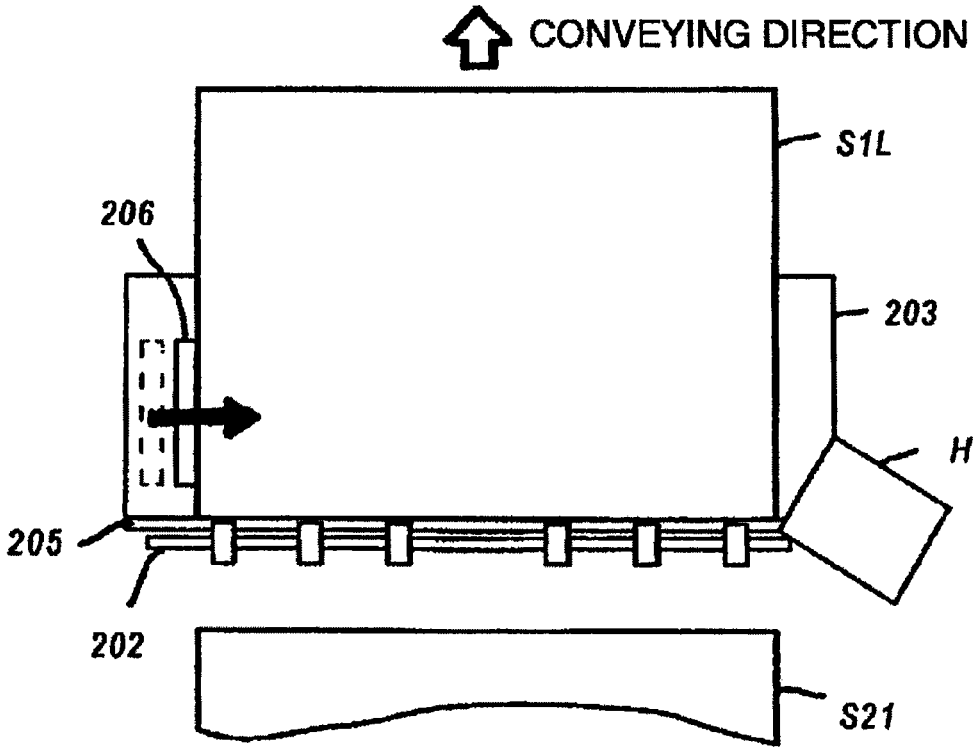
FIG. 3(*a*) is a top view of sheet processing apparatus.
Figure 3B:
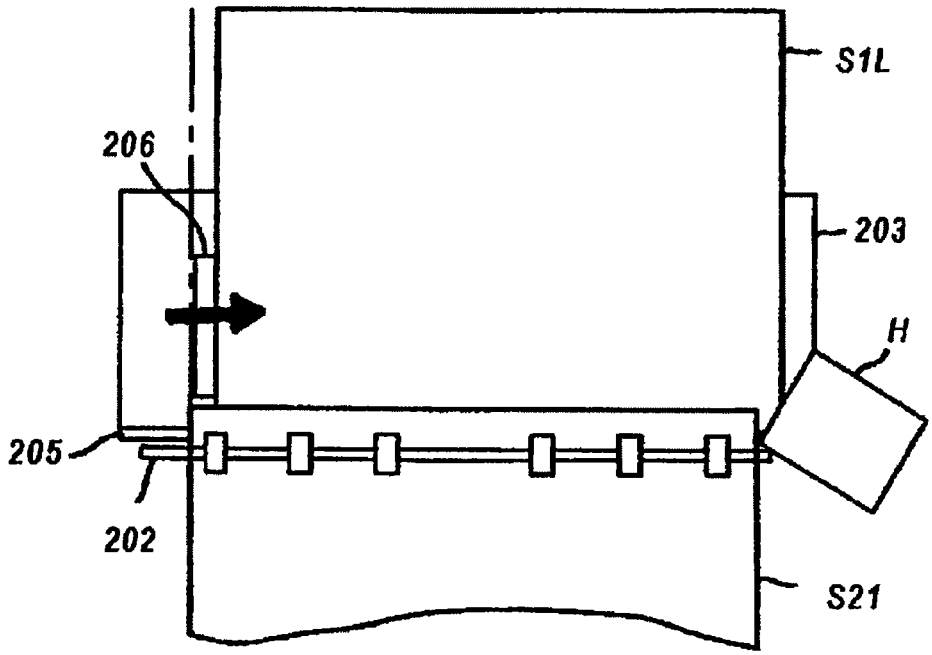

Referring now to FIGS. 2(*a*) to 2(*i*) and FIGS. 3(*a*) and 3(*b*), the next explanation is about stapling process conducted consecutively for executing plural jobs sent from the computer or the like through the network. That is, from placing of final sheet of preceding job on the stacking tray 203 in operation of sheet processing apparatus 200 until stapling and discharge of next job, the operation is specifically described below. FIGS. 2(*a*) to 2(*i*) explains the operation of sheet processing apparatus, and FIGS. 3(*a*) and 3(*b*) is a top view of sheet processing apparatus.

FIG. 2(*a*) shows a mode of placing of final sheet S1L of preceding job on the stacking tray. At this time, first sheet S21 of next job is conveyed into the sheet processing apparatus 200 at ordinary sheet interval to final sheet S1L of preceding job. When final sheet S1L is discharged onto the stacking tray 203, the set-away return roller 204 approaches and compresses final sheet S1L, and conveys final sheet S1 in the direction of reference wall 205, and thereby matches in the sheet conveying direction (FIG. 2(*b*)), and is aparted again after aligning (FIG. 2(*c*)).

In this period, the sheet S21 is conveyed through the first path 209 without stop, and the sheet front end passes over the discharge roller pair 202 (FIG. 2(*d*)). Herein, the lateral aligning plate 206 begins to match in orthogonal direction to sheet conveying direction of final sheet S1L before the front end of sheet S21 reaches the discharge roller pair 202 (FIG. 3(*a*)), and until the front end of sheet S21 passes over the discharge roller pair 202, the move in orthogonal direction to sheet conveying direction to stapler H side is terminated (FIG. 3(*b*)). At this time, sheet S21 is conveyed while contacting with the upper end side of the lateral aligning plate 206.

Next, when the front end of sheet S21 has passed over the discharge roller pair 202, the discharge roller pair 202 is aparted. Further, when the sheet rear end of sheet S21 has passed over the first path roller 201, the switching flapper 212 is changed over, and the front end of sheet S21 projects into the upper space of the stacking tray 203, and the sheet rear end is held by the switching flapper 212 in the first path 209. At the same time, sheet S22 of second job can be introduced into the second path 210 (FIG. 2(*d*)). Before the rear end of sheet S21 passes over the first path 201, aligning of sheet bundle S1 of preceding job in direction orthogonal to sheet conveying direction, and sewing process by stapler H have been terminated. In this embodiment, the sheet rear end of sheet S21 is held by the switching flapper 212, but alternatively a sheet rear end stopper for holding sheet rear end of sheet S21 after passing over the first path roller 201 may be provided at the downstream side of the first path roller 201. By such structure of holding the sheet rear end, the sheet front end side can be held in a state projecting from the first path 209 while the discharge roller pair 202 of processing tray is aparted, and the first path 209 can be set shorter than the sheet length, so that the apparatus can be smaller in size.

In succession, while the first sheet S21 is being held by the switching flapper 212, a second sheet S22 is conveyed into the second path 210. At this time, the discharge roller 207 nips and conveys the sheet bundle S1 of preceding job, and the sheet bundle S1 is discharged (FIG. 2(*e*)), and when discharge of sheet bundle S1 is complete, the discharge roller 207 is aparted again (FIG. 2(*f*)). Since the first path 209 and second path 210 are disposed as independent paths as being partitioned by guide plate, and second sheet S22 does not contact directly to push out first sheet S21 held in the first path 209. However, since the first path 209 and second path 210 meet together before the discharge roller pair 202, the front end of sheet S21 may contact with sheet S21 to push out, but in this embodiment, the first path 209 is curved widely to provide sheet S21 with tenacity, and frictional resistance in the first path 209 is increased to preventing from pushing out. Holding of sheet S21 in first path 209 may be realized only by curved structure of first path 209, but it is preferred to combine with sheet holding by switching flapper 212. More secure holding is possible by adhering a frictional member to the contact portion of switching flapper 212 and sheet, or forming a frictional member such as undulated surface. The switching flapper 212 may be formed of an elastic material, and the rear end of sheet S21 may be pressed down.

The sheet S22 continues to be conveyed by a specified distance by the second path roller 211, after the sheet rear end has passed over the first path roller 201, until it is aligned with the front end of sheet S21 or the front end of sheet S22 moves ahead of the front end of sheet S21. At the timing of the front end of sheet S22 aligning with the front end of sheet S21, or the front end of sheet S22 moving ahead of the front end of sheet S21, the discharge roller pair 202 is compressed (FIG. 2(*g*)), and two sheets S21, S22 are superimposed in the aligned state of front ends of S21 and S22, or in the state front end of S22 ahead of front end of S21, and discharged onto the stacking tray 203 (FIG. 2(*h*)).

The sheet S22 is superimposed on the sheet S21 and discharged onto the stacking tray 203, and the return roller 204 pushes the sheet rear end against the reference wall 205 and matches in the sheet conveying direction, and at this time, the return roller 204 acts only on the top of the sheet S22. The return roller 204 continues the returning action until the rear end of the upper sheet S22 abuts against the reference wall 205, but by the frictional action between sheet S22 and sheet S21, sheet S22 and sheet S21 are pushed back together. At this time, if the sheets are stacked with the front end of sheet S22 with projecting, first, the rear end of sheet S21 hits against the reference wall 205, and then the rear end of sheet S22 hits against the reference wall 205, and aligning is complete, but on the contrary if the sheets are stacked with the front end of the first sheet S21 with projecting, aligning is complete when the front end of sheet S22 hits against the reference wall 205. This is the reason why the front end of the second sheet S22 is moved ahead of the front end of the first sheet S21.

Incidentally, the second path 210 is disposed outside of the first path 209, that is, at the opposite side of stacking side on stacking tray 203 with respect to the conveying side of the first path 209, and hence the sheet S21 is located at the stacking tray 203 side from the sheet S22. Since the sheets are discharged face-down, with the image surface at the stacking tray 203 side, with sheet S22 superimposed on sheet S21, the sheets are stacked in the page sequence. Herein, the sheet S22 does not stop until discharged onto the stacking tray 203. The lateral aligning plate 206 completely moved away to the sheet receiving position (outside of sheet passing range) before sheets S21, S22 are discharged onto the stacking tray 203.

Afterwards, until a third sheet S23 is fed in, the return roller 204 matches in the sheet conveying direction, and the lateral aligning plate 206 matches in the orthogonal direction to sheet conveying direction (FIG. 2(*i*)). After third sheet S23, without stopping in the first path 209, the sheets directly pass over the first path 209 and are consecutively discharged and matched on the stacking tray 203, and are finally stapled and discharged. The sheet S23 and the following sheets are discharged face-down on the top of the stacked sheets with the image surface at the stacking tray 203 side, so that the page sequence will not be disturbed.

Second Embodiment

Figure 4:
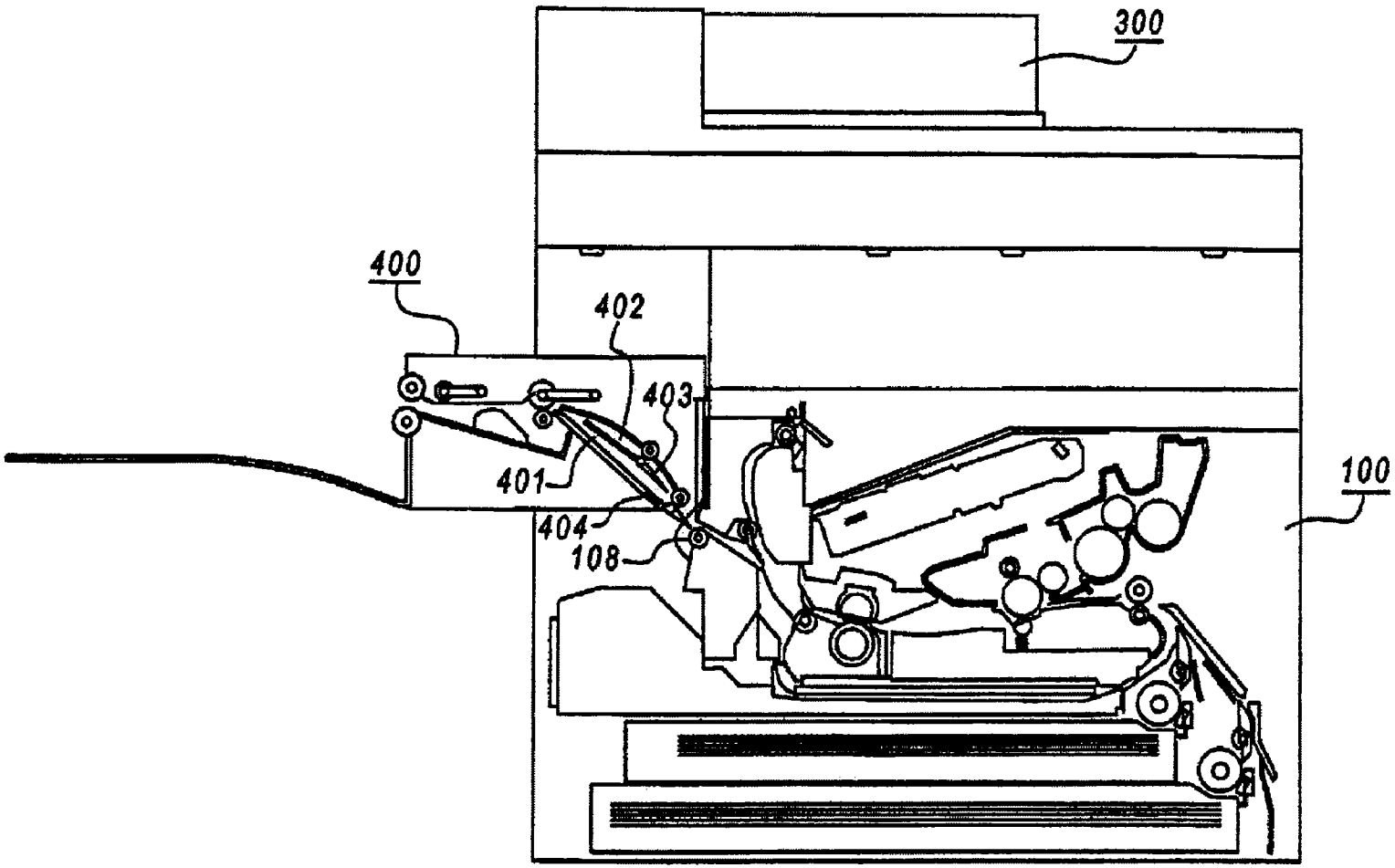
FIG. 4 is a diagram explaining the configuration of sheet processing apparatus according to a second embodiment.

A second embodiment of sheet processing apparatus of the invention is described. FIG. 4 is a diagram explaining the configuration of sheet processing apparatus of the second embodiment, and FIGS. 5(*a*) and 5(*b*) is a diagram explaining the operation of sheet processing apparatus, and same parts as in the first embodiment are identified with same reference numerals, their explanation is not described.

This embodiment is different from the first embodiment in the shape of the conveyance path from first path roller 201 to discharge roller pair 202.

As shown in FIG. 4, a sheet processing apparatus 400 of the embodiment is disposed in an upper and side portion of image forming apparatus 100, and is designed to discharge the sheet bundle after post-processing to outside of the machine. A first path 401 is nearly straight, and a second path 402 is curved and disposed closely to the first path 401. In this embodiment, after images are formed in the image forming apparatus 100, sheets are conveyed in face-up state, and to discharge the sheets in page sequence, by the control of image formation, images may be formed in reverse order from final page to first page, or by switching back by using the face-down discharge unit on the image forming apparatus 100, the sheets may be conveyed in face-down state in the first path 401 and second path 402 by an inverting path (not shown). Besides, a friction member 404 is provided at the position of the first path 401 opposite to the switching flapper 403 for changing over the first path 401 and second path 402.

Figure 5A:
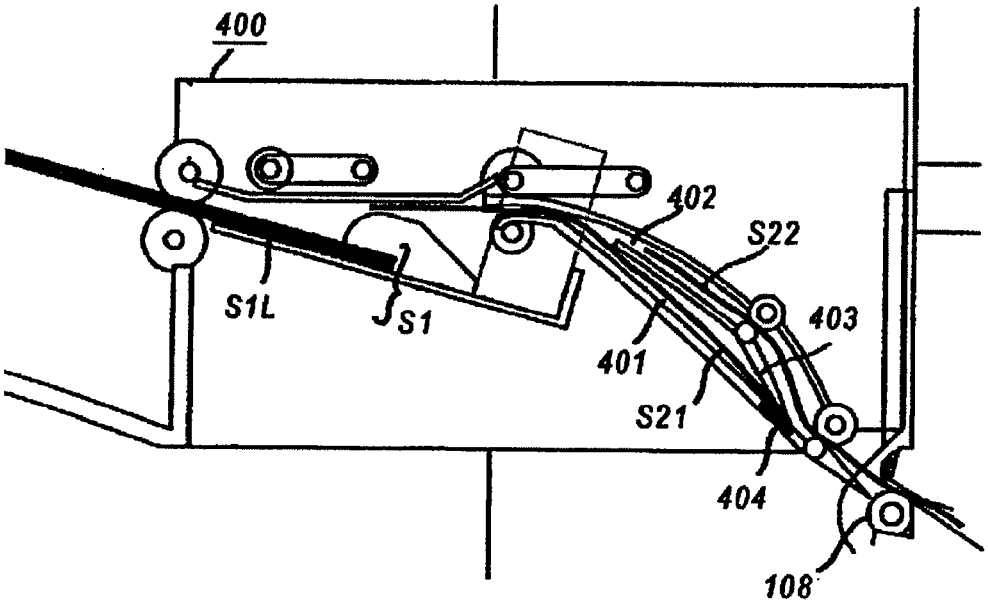
FIG. 5(*a*) is a diagram explaining the operation of sheet processing apparatus.
Figure 5B:
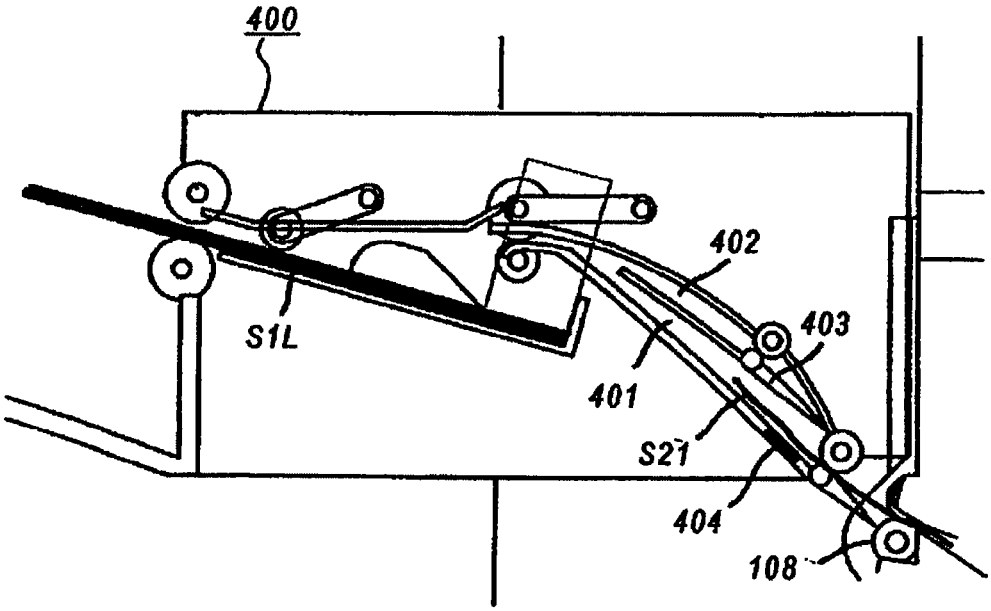

Referring to FIGS. 5(*a*) and 5(*b*), stapling operation of consecutive jobs in the sheet processing apparatus 400 of the preferred embodiment is explained.

In this embodiment, same as in the first embodiment, after the final sheet S1L of preceding job is discharged, it is matched and sewn, and in this process, a first sheet S21 of next job is conveyed (FIG. 5(*a*)), and then a second sheet S22 is conveyed. At this time, by the switching flapper 403 and friction member 404, the rear end of first sheet S21 is gripped and held (FIG. 5(*b*)). In this embodiment, the friction member 404 is provided at the first path 401 side, but the friction member 404 may be provided at least at one side of the first path 401 and switching flapper 403. A greater effect will be obtained by forming the switching flapper 403 by an elastic member.

In this configuration, if the sheet processing apparatus does not have a widely curved path as in the first embodiment, at least the front end of second sheet S22 does not push out the first sheet S21 by friction. Therefore, in addition to the same effects as in the first embodiment, since curve path is not particularly required, the apparatus can be composed by using paths of free shape, and the apparatus may be further reduced in size, and it is possible to connect to various image forming apparatuses, and the applicability of the apparatus can be extended.

Third Embodiment

Figure 6:
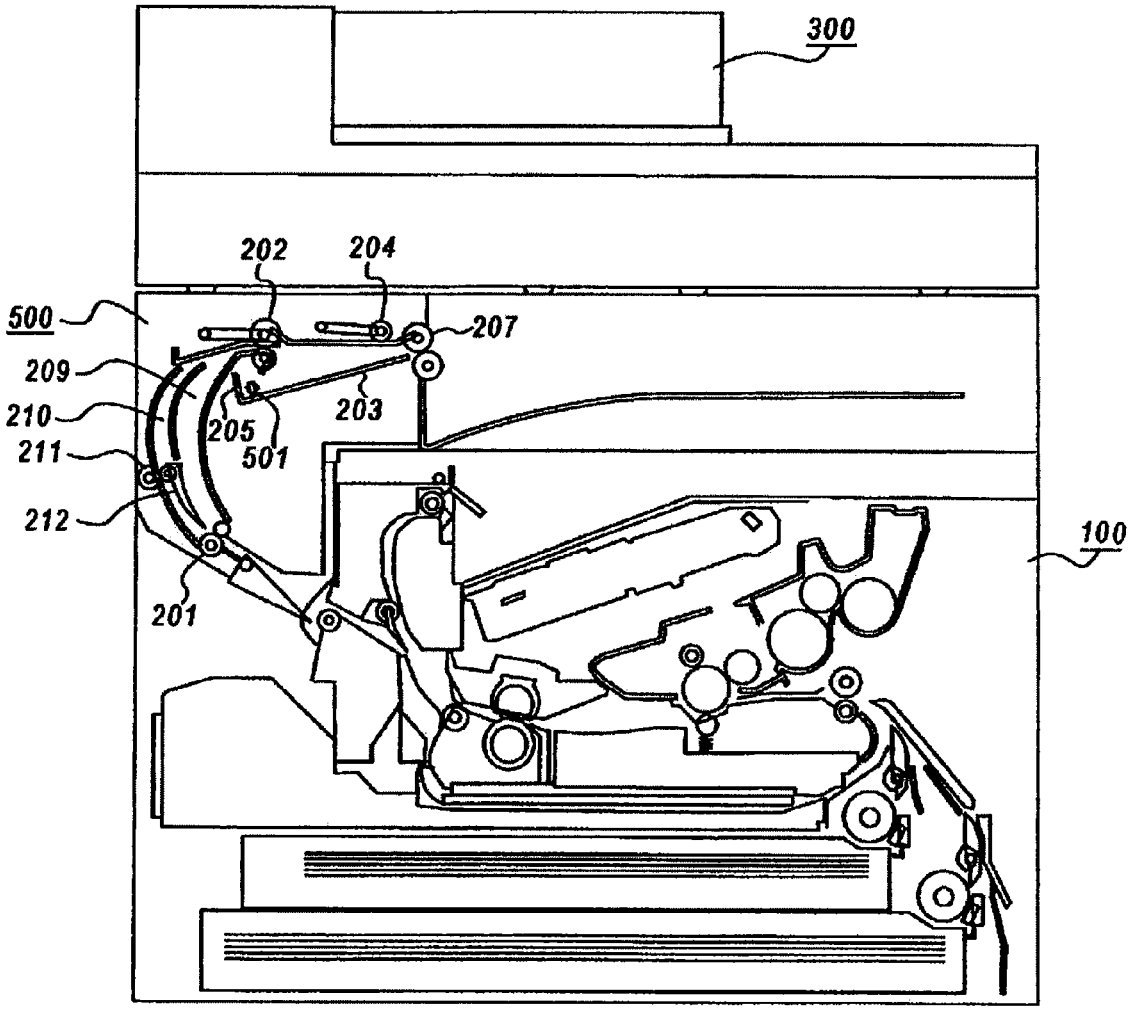
FIG. 6 is a diagram explaining the configuration of sheet processing apparatus according to a third embodiment.

A third embodiment of sheet processing apparatus of the invention is described. FIG. 6 is a diagram explaining the configuration of sheet processing apparatus of the third embodiment, and FIG. 7(*a*) to 7(*e*) is a diagram explaining the operation of sheet processing apparatus, and same parts as in the first embodiment are identified with same reference numerals, their explanation is not described.

This preferred embodiment is different from the first embodiment in the aligning means in a direction orthogonal to sheet conveying direction.

In a sheet processing apparatus 500 shown in FIG. 6, a lateral aligning roller 501 for aligning sheets in a direction orthogonal to sheet conveying direction is provided beneath discharge roller pair 202 and at the upstream side in sheet conveying direction. In this embodiment, the lateral aligning roller 501 moves the sheet in a direction orthogonal to sheet conveying direction, but the lateral aligning roller 501 may have an angle against reference wall 205 so as to move the sheet while pushing against the reference wall 205 and match also in sheet conveying direction.

Referring to FIG. 7(*a*) to 7(*e*), stapling operation of consecutive jobs in the sheet processing apparatus 500 of the preferred embodiment is explained.

Figure 7A:
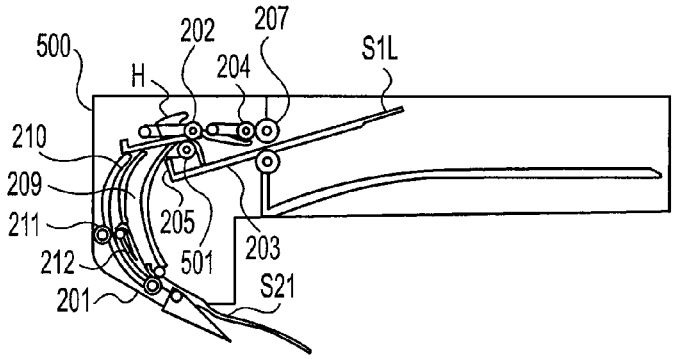
FIG. 7(*a*) is a diagram explaining the operation of sheet processing apparatus.
Figure 7B:
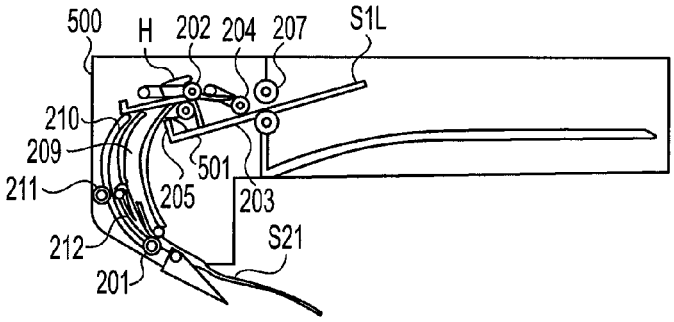
Figure 7C:
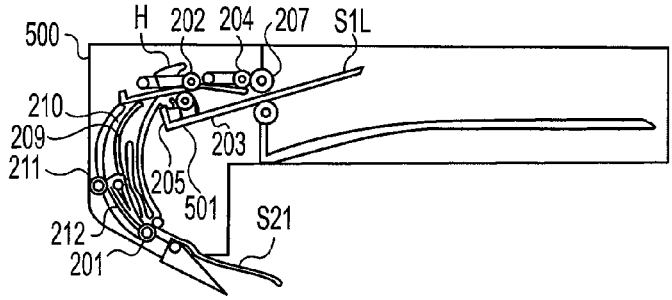
Figure 7D:
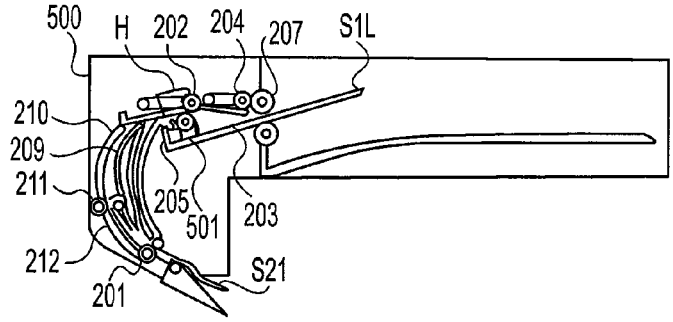
Figure 7E:
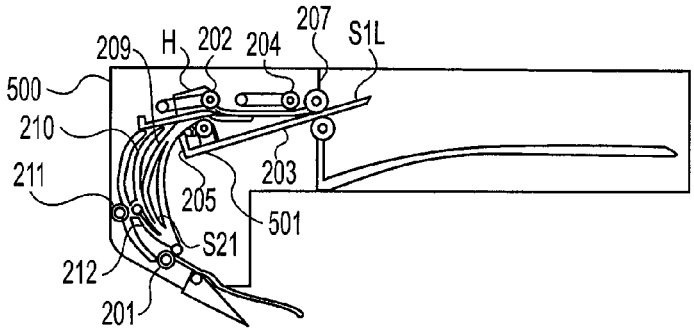

FIG. 7A shows a mode of final sheet S1L of preceding job stacked on the stacking tray. At this time, first sheet S21 of next job is conveyed into the sheet processing apparatus 500 at an ordinary sheet interval with respect to final sheet S1L of preceding job. When final sheet S1L is discharged onto the stacking tray 203, the set-away return roller 204 approaches and compresses final sheet S1L, and conveys the sheet in the direction of reference wall 205, and thereby matches in the sheet conveying direction (FIG. 7(*b*)), and is aparted again after aligning (FIG. 7(*c*)). During this operation, the lateral aligning roller 501 is set away from the top of the sheet bundle.

In this period, the sheet S21 is conveyed through the first path 209 without stop, and the sheet front end passes over the discharge roller pair 202. At this time, the lateral aligning roller 501 compresses the final sheet S1L, and matches the sheet in a direction orthogonal to sheet conveying direction (FIG. 7(*d*)).

When the front end of sheet S21 passes over the discharge roller pair 202, the discharge roller pair 202 is aparted. Further, when the sheet rear end of sheet S21 passes over the first path roller 201, the sheet S21 is held by the first path 209, with its front end projecting into the upper space of the stacking tray 203. At this time, the switching flapper 212 is changed over, and second sheet S22 of next job can be introduced into the second path 210 (FIG. 7(*e*)). Herein, before the rear end of first sheet S21 passes over the first path roller 201, aligning of sheet bundle S1 of preceding job in a direction orthogonal to sheet conveying direction, and sewing process by the stapler H have been terminated, and the lateral aligning roller 501 is aparted from the top of the sheet bundle.

The subsequent operation of stapling mode is same as in the first embodiment, and explanation is not described.

In this configuration, aligning in direction orthogonal to sheet conveying direction is realized by using a lateral aligning roller provided at the upstream side from the discharge roller pair 202, and the stacking tray 203 can be reduced in size, and the apparatus can be further reduced in size.

The invention is applied in a sheet processing apparatus for collecting, aligning and post-processing the sheets discharged from an image forming apparatus.

This application claims priority from Japanese Patent Application No. 2004-249952 filed Aug. 30, 2004, which is hereby incorporated by reference herein.

What is claimed is:

1. A sheet processing apparatus comprising:

a stacking tray on which the sheets to be processed are stacked, and which provides a return member for aligning the stacked sheets in a sheet conveying direction and a reference wall against which rear ends of sheets in the sheet conveying direction are abutted by the return member;

a discharge roller pair which discharges a sheet on the stacking tray, and which rollers can move apart from each other and close to each other;

a first path in which a sheet is conveyed to the discharge roller pair, wherein a length of the first path is shorter than the length of the minimum sheet size being conveyed in the sheet conveying direction;

a second path branched from the first path at a branching point and meeting with the first path at an upstream side in the sheet conveying direction of the discharge roller pair;

a first conveyance roller, disposed at one end of the first path, which is disposed upstream of the branching point in the sheet conveying direction;

a path switching member, disposed at the branching point, which guides a sheet selectively to the first path or the second path; and a controlling device which controls, sheet conveyance, wherein the controlling device controls so that, after a first sheet is guided into the first path by the path switching member and the front end of the first sheet is projected from the discharge roller pair, the rollers of the discharge roller pair are apart from each other and the first sheet is held in the first path, and then the path switching member is changed over and a second conveyed sheet is guided into the second path with the first sheet kept to project the front end of the first sheet from the discharge rollers, and wherein the controlling device controls, so that when the front end of the second sheet projects from the front end of the first sheet by a prescribed length, the rollers of the discharge roller pair are brought close to each other, the first and second sheets are discharged onto the stacking tray by the discharge roller pair in a state that the second sheet is superimposed on the first sheet, the front end of the second sheet leading ahead by the prescribed length from the front end of the first sheet, and the first and second sheets are aligned in the sheet conveying direction by action of the return member on the top of the second sheet; wherein the path switching member is changed over after the rear end of the first sheet has passed over the first conveyance roller.

2. The sheet processing apparatus according to claim 1, further comprising:

a second conveyance roller disposed in the second path, wherein conveyance of the second sheet is continued by the second conveyance roller after the second sheet is guided into the second path, the second sheet is superimposed on the first sheet, and is discharged onto the stacking tray.

3. The sheet processing apparatus according to claim 1, wherein the first path and second path are curved upward from downward, the second path is disposed to the outer side of the curvature of the first path, and the first and second sheets are discharged onto the stacking tray in face-down state.

4. The sheet processing apparatus according to claim 1, wherein third and subsequent sheets are conveyed through the first path, and discharged onto the stacking tray.

5. The sheet processing apparatus according to claim 1, wherein the path switching member holds the rear end of the first sheet.

6. The sheet processing apparatus according to claim 5, further comprising:

a friction member disposed at either opposite position of the path switching member or the first path.

7. The sheet processing apparatus according to claim 5, wherein the path switching member is an elastic member.

8. The sheet processing apparatus according to claim 1, further comprising;

an aligning plate which aligns by moving the sheets stacked on the stacking tray in a direction crossing with sheet conveying direction.

9. The sheet processing apparatus according to claim 1, further comprising;

a aligning roller which aligns the sheets stacked on the stacking tray in a direction crossing with sheet conveying direction.

10. An image forming apparatus comprising:

an image forming portion which forms an image on a sheet; and a sheet processing apparatus which processes sheets on which images are formed, wherein the sheet processing apparatus includes:

a stacking tray on which the sheets to be processed are stacked, and which provides a return member for aligning the stacked sheets in a sheet conveying direction and a reference wall against which rear ends of sheets in the sheet conveying direction are abutted by the return member;

a discharge roller pair which discharges a sheet on the stacking tray, and which rollers can move apart from each other and close to each other;

a first path in which a sheet is conveyed to the discharge roller pair, wherein a length of the first path is shorter than the length of the minimum sheet size being conveyed in the sheet conveying direction;

a second path branched from the first path at a branching point and meeting with the first path at an upstream side in the sheet conveying direction of the discharge roller pair;

a first conveyance roller, disposed at one end of the first path, which is disposed upstream of the branching point in the sheet conveying direction;

a path switching member disposed at the branching point, which guides a sheet selectively to the first path or the second path; and a controlling device which controls, sheet conveyance, wherein the controlling device controls so that, after a first sheet is guided into the first path by the path switching member and the front end of the first sheet is projected from the discharge roller pair, the rollers of the discharge roller pair are apart from each other and the first sheet is held in the first path, and then the path switching member is changed over and a second conveyed sheet is guided into the second path with the first sheet kept to project the front end of the first sheet from the discharge rollers, and wherein the controlling device controls, when the front end of the second sheet projects from the front end of the first sheet by a prescribed length, the rollers of the discharge roller pair are close to each other the first and second sheets are discharged onto the stacking tray by the discharge roller pair in a state that the second sheet is superimposed on the first sheet, and the first and second sheets are aligned in the sheet conveying direction by acting of the return member on the top of the second sheet with the front end of the second sheet leading ahead by the prescribed length from the front end of the first sheet; wherein the path switching member is changed over after the rear end of the first sheet has passed over the first conveyance roller.

11. The image forming apparatus according to claim 10, wherein the discharge roller pair is closed to each other at the timing of the front end of the second sheet leading ahead by a prescribed length from the front end of the first sheet, and the sheets are discharged onto the stacking tray, with the front end of the second sheet leading ahead by a prescribed length from the front end of the first sheet.

12. The image forming apparatus according to claim 10, further comprising:

a second conveyance roller disposed in the second path, wherein conveyance of the second sheet is continued by the second conveyance roller after the second sheet is guided into the second path, and it is superimposed on the first sheet, and is discharged onto the stacking tray.

13. The image forming apparatus according to claim 10, wherein the first path and second path are curved upward from downward, the second path is disposed to the outer side of the curvature of the first path, and the first and second sheets are discharged onto the stacking tray in face-down state.

14. The image forming apparatus according to claim 10, wherein the path switching member holds the rear end of the first sheet.

15. The image forming apparatus according to claim 14, further comprising:

a friction member disposed at either opposite position of the path switching member or the first path.

16. The image forming apparatus according to claim 14, wherein the path switching member is an elastic member.

* * * * *